US005661497A

United States Patent [19]

Calearo

[11] Patent Number: 5,661,497

[45] Date of Patent: Aug. 26, 1997

[54] ANTENNA FOR MOTOR VEHICLES

[76] Inventor: Massimo Calearo, Via N. Sauro, 22, 36030 Costabissara (VI), Italy

[21] Appl. No.: 609,640

[22] Filed: Mar. 1, 1996

[51] Int. Cl.[6] ..... H01Q 1/32; H01Q 3/02

[52] U.S. Cl. ..... 343/715; 343/882; 343/888

[58] Field of Search ..... 343/715, 878, 343/880, 882, 888, 900, 906

[56] References Cited

U.S. PATENT DOCUMENTS

| | | | |
|---|---|---|---|
| 4,115,779 | 9/1978 | Dantzler et al. | 343/715 |
| 4,266,227 | 5/1981 | Blaese | 343/715 |
| 4,785,305 | 11/1988 | Shyu | 343/715 |
| 5,032,846 | 7/1991 | Chang | 343/882 |
| 5,099,251 | 3/1992 | Fisher | 343/882 |
| 5,402,135 | 3/1995 | DeMarre et al. | 343/715 |
| 5,451,966 | 9/1995 | Du et al. | 343/715 |

*Primary Examiner*—Donald T. Hajec
*Assistant Examiner*—Tan Ho
*Attorney, Agent, or Firm*—Watson Cole Stevens Davis, P.L.L.C.

[57] ABSTRACT

An antenna wherein a rod is connected to a supporting base by articulated joint formed by a first articulation element rigidly connected to the supporting base and a second articulation element connected to the rod. The first and second articulation elements have contacting toothed surfaces which revolvingly cooperate to permit orientation of the rod to a selected orientation.

14 Claims, 6 Drawing Sheets

ANTENNA FOR MOTOR VEHICLES

BACKGROUND OF THE INVENTION

The invention concerns an antenna particularly suited to be applied on motor vehicles. It is a known fact that antennas for motor vehicles essentially consist of a base applied to the body of the car and supporting a rod which constitutes the active element of the antenna.

In the embodiments belonging to the known technique, the rod of the antenna is fixed in relation to its supporting base and, when it is mounted, it positions itself with an inclination which depends on the construction shape of the supporting base and on the position which said base acquires when it is applied to the body of the car.

It is understood that such embodiments entail a number of inconveniences.

First, the impossibility of positioning the antenna at different inclinations prevents an optimum exploitation of the same, above all when said antenna is used with a double function both for the reception of radio broadcastings and for two-way transmissions by radiophone.

Another inconvenience is also that the fixed antenna can be damaged by the impact against the rotating brushes of automatic carwashes.

The present invention proposes to overcome such inconveniences.

One purpose of the invention is to obtain an antenna particularly suited to be mounted on motor vehicles, equipped with a rod adjustable in inclination in relation to the supporting base by means of which it is applied to the motor vehicle.

It is another purpose that the rod of said antenna can be locked in any of the adjusting positions in which it can be arranged.

It is another purpose that the antenna according to the invention presents theft-preventing characteristics such as to prevent the rod from being removed from its supporting base.

Not the last purpose is that the connection of the rod of the antenna with its supporting base can be performed without using removable connecting means such as screws, locks, plugs and similar.

SUMMARY OF THE INVENTION

The described purposes are reached by an antenna particularly suited to be mounted on motor vehicles which, in accordance with the main claim comprises a rod connected to a supporting base applied to a surface supporting the antenna and is characterized in that said rod is connected to said supporting base by means of an articulated joint which is formed by a first articulation element rigidly connected to said supporting base by means of first connecting means and by a second articulation element connected to said rod by means of second connecting means, said first and said second articulation elements revolvingly co-operating with each other in order to permit the orientation of said rod of said antenna in relation to said base and being equipped with contrasting means suited to permit the fixing of said rod in any of the orientation positions achieved by reciprocal interference between said contrasting means, when at least one of said connecting means reciprocally forces said articulation elements of said articulated joint.

According to one preferred embodiment, said first articulation element presents a body made of conductive material which is connected to said supporting base and equipped with a pair of rings co-axial with one another and placed at a distance from each other. Said second articulation element comprises an insulating reel having an essentially circular profile and presenting a seat wherein is inserted a conductive body, the extremities of which protrude in relation to said insulating reel and co-operate with the inner surface of said co-axial rings of said first articulation element, said insulating reel being coupled by rotation within a housing having an essentially circular profile, obtained in said first articulation element in the area comprised between said co-axial rings.

Said insulating reel and said conductive body are connected to the rod of said antenna. When the orientation position is reached the rod is locked because of the reciprocal interference between the toothed elements, joined together and co-operating with one another, which belong to said co-axial rings of said first articulation element and to said conductive body of said second articulation element.

BRIEF DESCRIPTION OF THE DRAWINGS

Further scope of applicability of the present invention will become apparent from the detailed description given hereinafter. However, it should be understood that the detailed description and specific example, while indicating a preferred embodiment of the invention, are given by way of illustration only, since various changes and modifications within the spirit and scope of the invention will become apparent to those skilled in the art from this detailed description and from the drawings, wherein.

DESCRIPTION OF THE INVENTION

Figure 2:
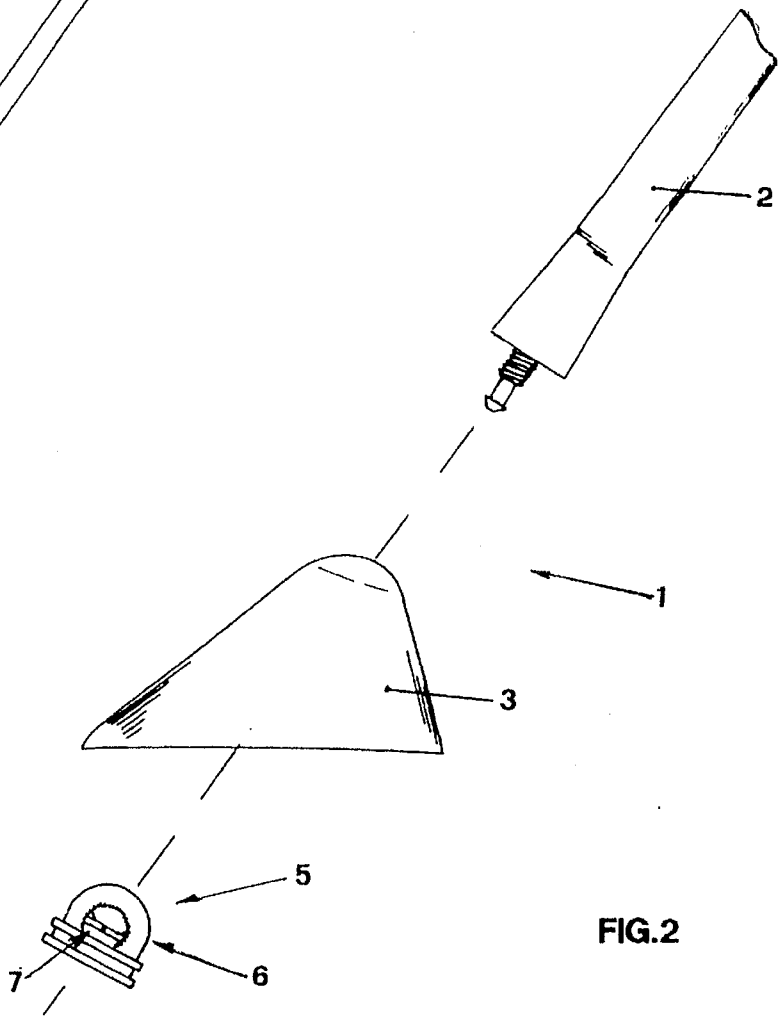
FIG. 2 shows in an exploded representation the supporting base, the rod and the articulated joint which compose the antenna according to the invention represented in FIG. 1.
Figure 1:
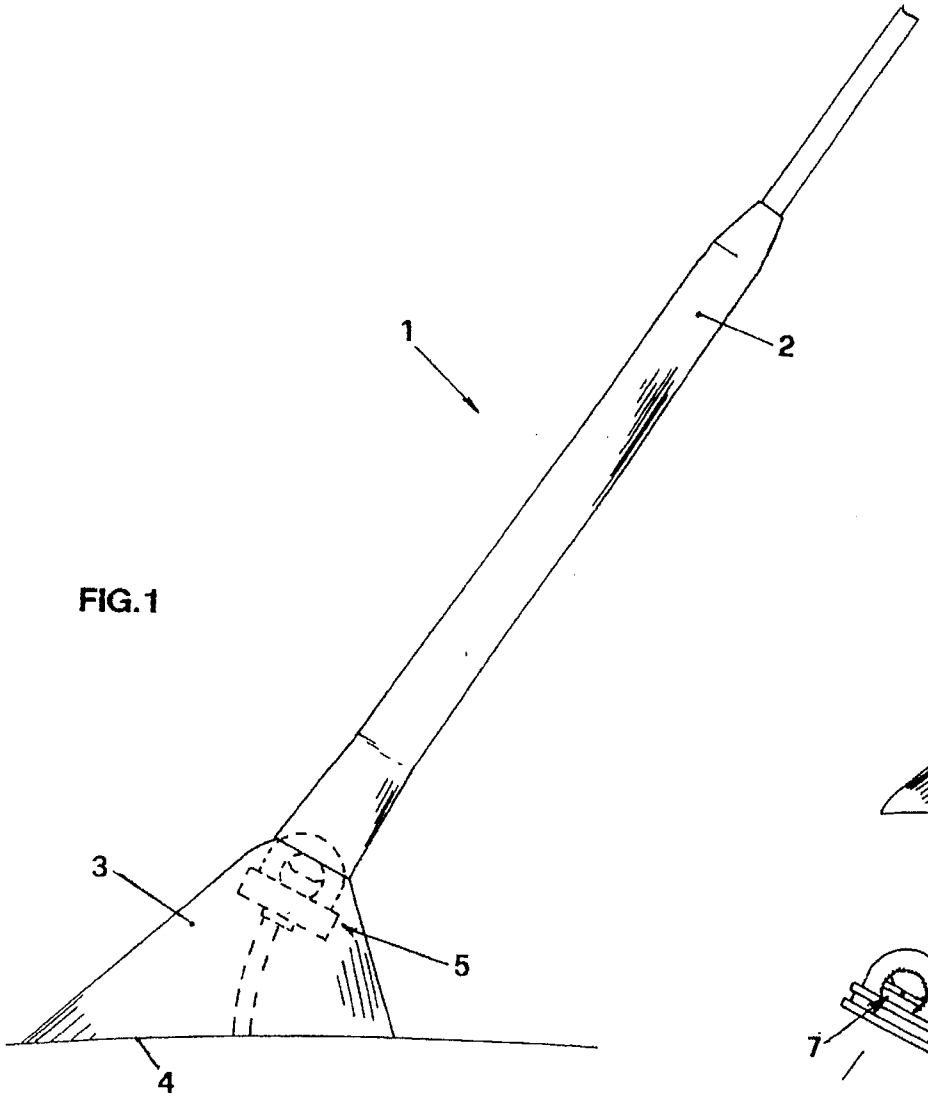
FIG. 1 shows the antenna according to the invention.

As can be observed in FIG. 1, the antenna according to the invention, indicated as a whole with 1, comprises a rod 2 connected to a supporting base 3 applied to a supporting surface 4 consisting of the body of a car, for instance. Said rod 2 is connected to said supporting base 3 by means of an articulated joint, indicated as a whole with 5, visible in better detail in the exploded representations of FIG. 2 and FIG. 3, which is composed by a first articulation element 6, connected to the base 3, which co-operates with a second articulation element 7 connected to the rod 2.

Figure 9:
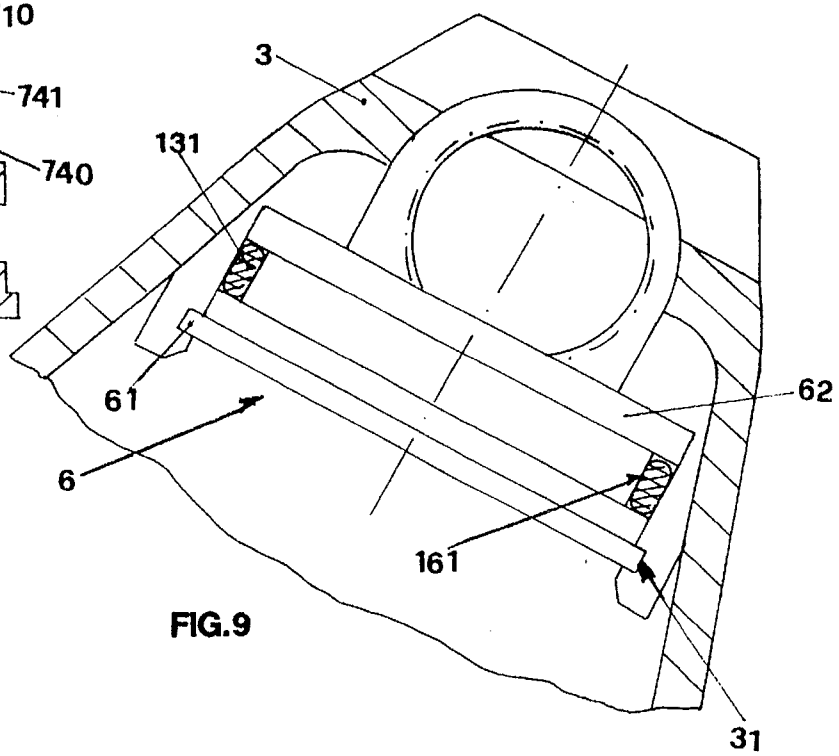
FIG. 9 shows the detail of the connection of the articulated joint to the base of the antenna.

Said first articulation element 6 is applied to said base 3 through first connecting means which consist of an annular area 61 arranged at the extremity of the body 62 of said first articulation element 6, said area snap-coupling with a corresponding annular duct 31 visible in FIG. 9 and obtained in the base 3 of the antenna itself. Said first articulation element 6 is made of conductive material and presents a pair of rings 63 co-axial with one another and placed at a distance from each other, which are preferably obtained from a single block in the body 62 of the element itself, and a housing 64, having an essentially circular profile, being defined between said two rings.

Figure 3:
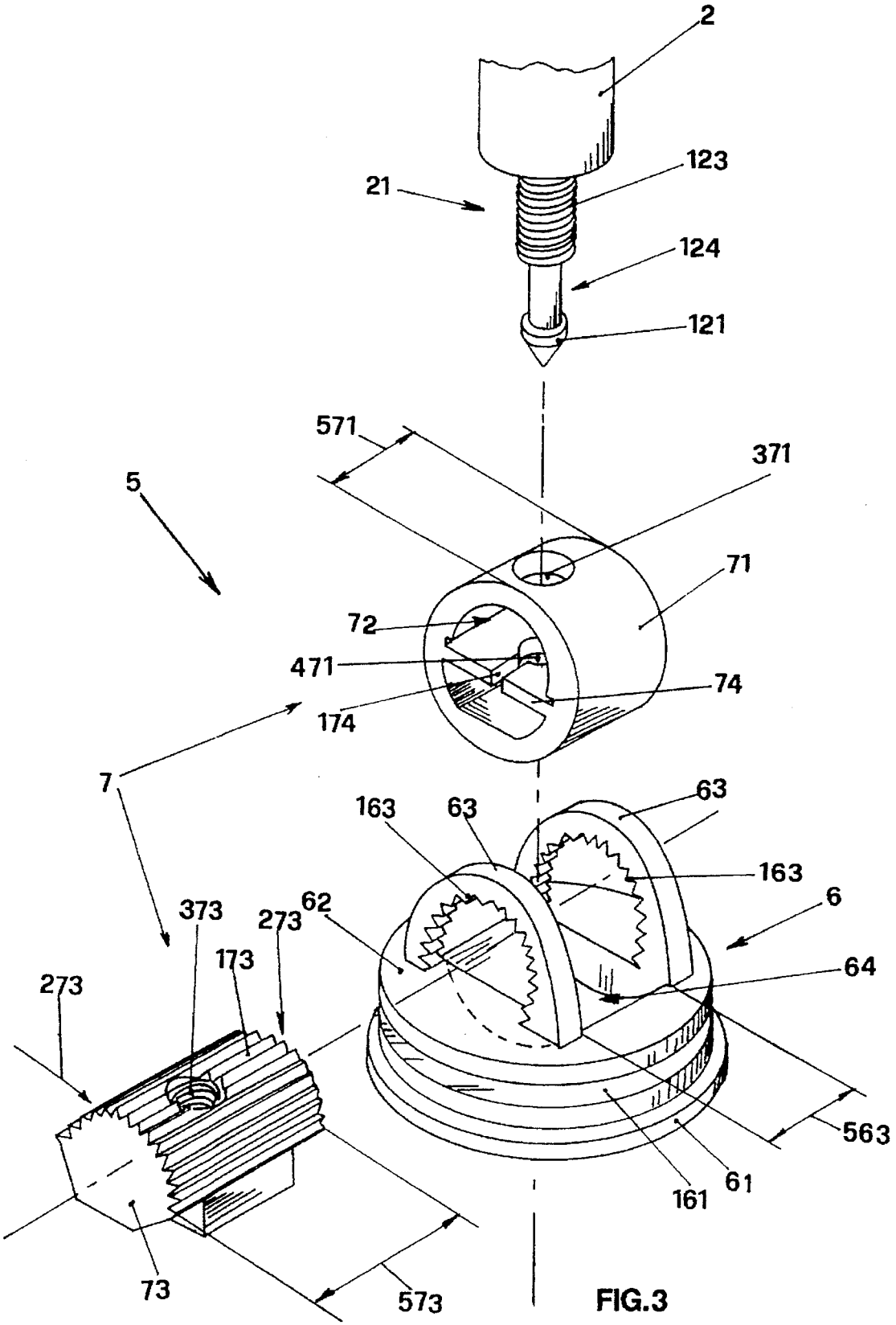
FIG. 3 shows in an axonometric exploded representation the detail of the articulated joint represented in FIG. 2.
Figure 4:
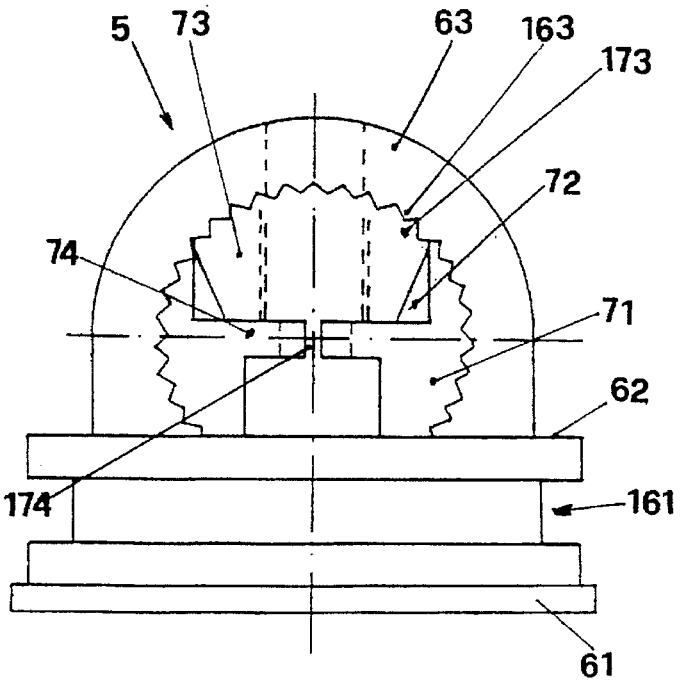
FIG. 4 shows the front view of the articulated joint of FIG. 3 already assembled.

Said second articulation element 7 comprises, as can be observed in FIG. 3, an insulating reel 71 having an essentially circular profile, which presents a seat 72 within which, as can be observed in better detail in FIG. 4, is inserted a body 73 made of conductive material. In particular, said seat 72 is defined inside said insulating reel 71 by the presence of a partition 74. Moreover, said insulating reel 71 has an axial length 571 equivalent to the axial distance 563 between the rings 63, so that said insulating reel 71 can be lodged in the housing 64 present between said rings 63.

Said conductive body 73 belonging to said second articulation element 7 and said co-axial rings 63 belonging to said articulation element 6 are equipped with contacting which comprise an outer toothing 173 obtained in said conductive body 73 and an inner toothing 163 obtained in each of said rings 63, wherein said toothings present conjugate profiles and such as to be able to reciprocally co-operate whenever said first and second elements are joined together.

It can be observed in particular in FIG. 3 that the conductive body 73 has an axial length 573 which is bigger than the axial length 571 of the insulating reel 71, so that when said conductive body 73 is lodged in the seat 72 of said insulating reel 71, once the latter has been inserted in the housing 64, its extremities 273 protruding from the reel 71 co-operate with the co-axial rings 63 by means of their corresponding toothings, as can be observed in FIG. 4.

It can be also observed that said conductive body 73 and said insulating reel 71 are equipped with second means for the connection to the rod 2 of the antenna which consist of a through hole 371 drilled in the body of said insulating reel 71 which positions itself co-axial with a corresponding threaded through hole 373 drilled in the body of said conductive body 73. This latter hole is in turn co-axial with another unthreaded through hole 471 drilled in the partition 74 of the insulating reel 71, wherein said holes are all lined up one after the other. In particular, in the FIGS. 3 and 4 it can be observed that said partition 74 also presents a slit 174 which communicates with its own said through hole 471 and which is suited to yield elasticity and flexibility to said partition in relation to the body of the insulating reel 71 to which it belongs.

Said second connecting means of said second articulation element 7, couple with a terminal element, indicated as a whole with 21, belonging to the rod 2 of the antenna and which comprises an essentially cylindrical body, mostly developed following an axial direction, which presents a threaded area 123 obtained in correspondence with said rod 2 and an unthreaded area 124 having a reduced diameter, arranged on the continuity of said threaded area 123. Said terminal element 21 also presents at the extremity a conic terminal element 121 having a bigger diameter than said unthreaded area 124. The presence of such a terminal element 21 permits the connection of the rod 2 to the articulated joint 5 whenever the threaded area 123 of said rod 2 couples with the corresponding threaded through hole 373 of the conductive body 73 and its unthreaded area 124 couples inside the through hole 471 drilled in the elastic partition 74 of the insulating reel 71.

Figure 5:
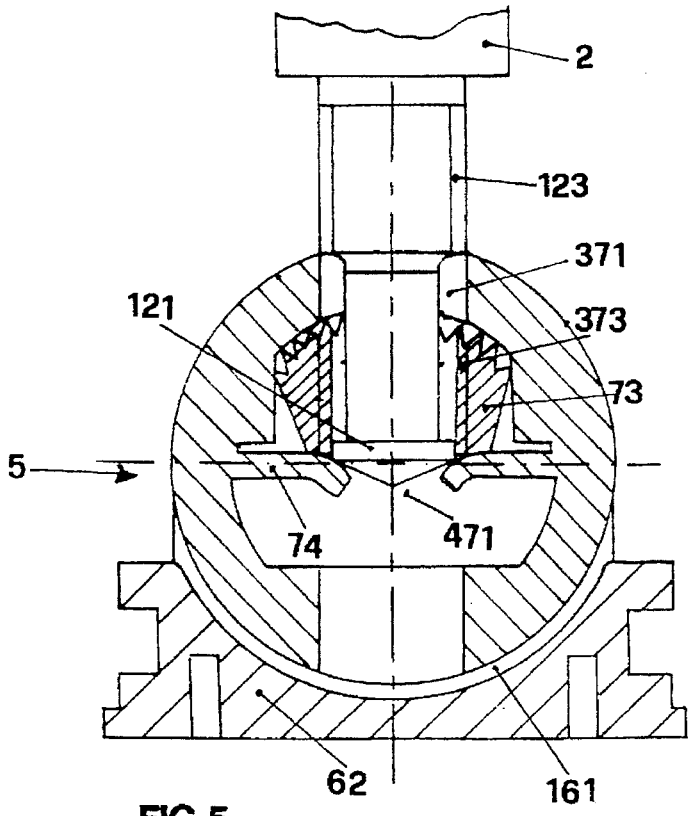
FIG. 5 shows the ball-and-socket joint of FIG. 4 in a cutaway representation according to a vertical midplane, while it is being assembled to the rod of the antenna.
Figure 6:
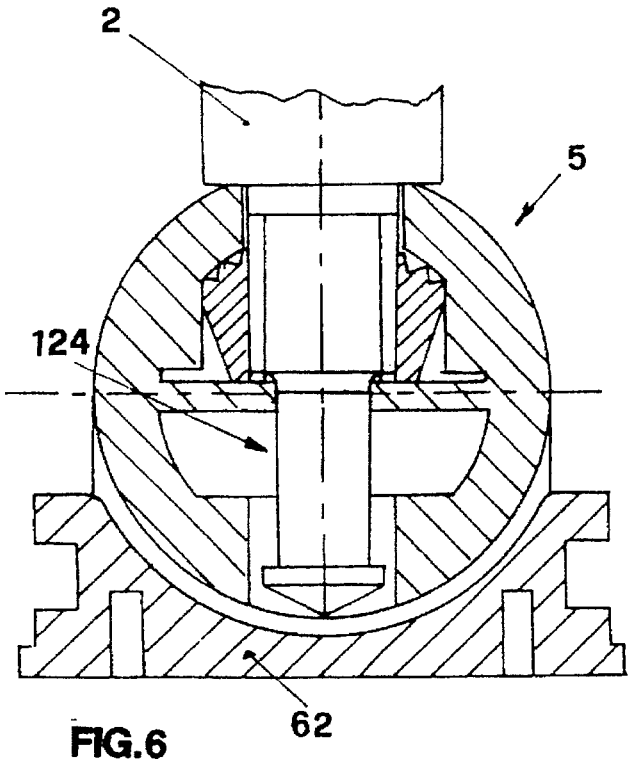
FIG. 6 shows the articulated joint represented in FIG. 5 once the assembling with the rod has been completed.

In FIG. 5 it can be observed that when coupled with said terminal element 21 with said articulated joint 5, when said threaded area 123 is coupled with the threaded hole 373 of the metallic conductive body 73, the conic terminal element 121 forces against the hole 471 of the elastic partition 74 thus deforming the same, as represented in FIG. 5. When such a deformation reaches its highest value, the conic terminal element 121 penetrates into the hole 471 and the terminal element 21 couples its unthreaded area 124 inside the hole 471 itself, while the threaded area 123 is screwed in the threaded hole 373 until the rod 2 stops against the insulating reel 71, as can be observed in FIG. 6.

Figure 10:
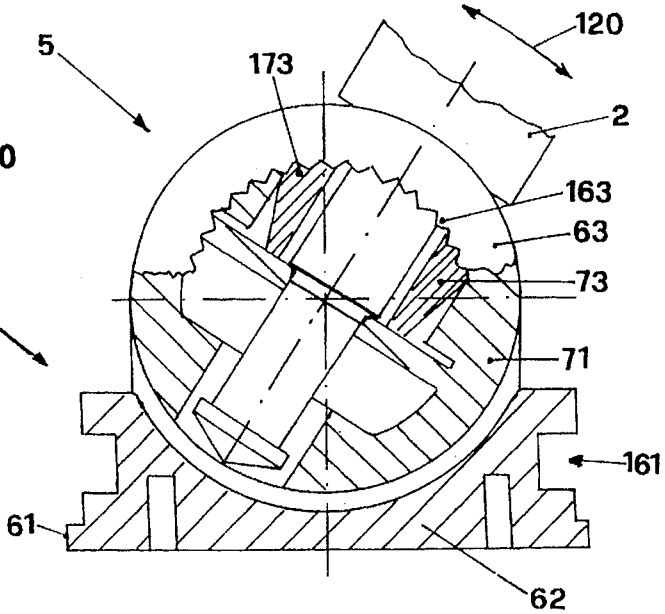
FIG. 10 shows a different embodiment of the articulated joint.

When the rod 2 is coupled with the articulated joint 5, the contact of the toothings 173 and 163 with one another permits a stick-slip rotation of the rod 2, as can be observed in FIG. 10, following any of the directions represented by the arrow 120 which are made possible by the rotation of the insulating reel 71 inside the housing 64 within which it is inserted.

If it is necessary to lock the rod in any of the reached angular positions, it will suffice to tighten the rod 2 into the threaded hole 373 so as to force the metallic conductive body 73 against the co-axial rings 63, thus creating an interference between the respective toothings.

Therefore, it can be noticed that the antenna according to the invention permits the orientation of the rod 2 in any of the directions shown in the plan of the drawing indicated by the arrow 120. Moreover, any reached position can be maintained because of the reciprocal interference of the toothings 163 and 173 present in the articulated joint element 5, by tightening the rod 2. This yields the advantage that the antenna can be pointed in the best position, whether it is used as an antenna for the reception of radio broadcastings or as an antenna for the two-way transmission by radiophone.

Figure 11:
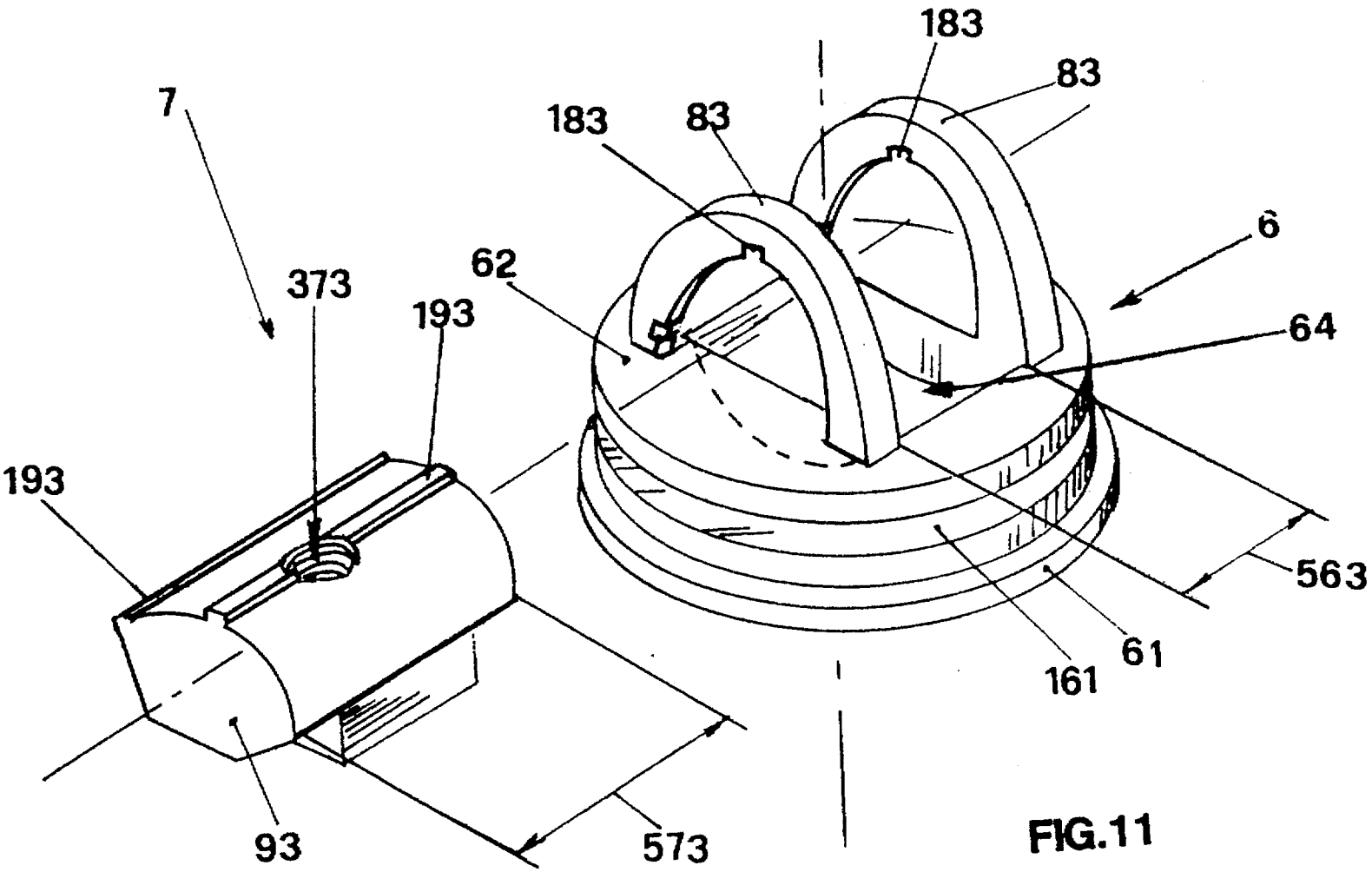
FIG. 11 shows a different embodiment of the articulated joint shown in FIG. 3.

When the antenna is used only for the reception of radio broadcasting, said kind of antenna can be sated only in two different positions: one position, substantially vertical is respect to the roof of the car, when the antenna is in reception; another position, substantially horizontal in respect to the roof of the car during the washing of the car for preventing damages to the antenna. In this case, according to a different embodiment of the invention shown in FIG. 11, the coaxial rings 83 belonging to the first articulation element 6, present an inner toothing 183 reduced only to two teeth. In the same way the conductive body 93 presents two teeth 193, so the outer toothing 193 and the inner toothing 183 permit to direct the antenna only in two positions.

Figure 7:
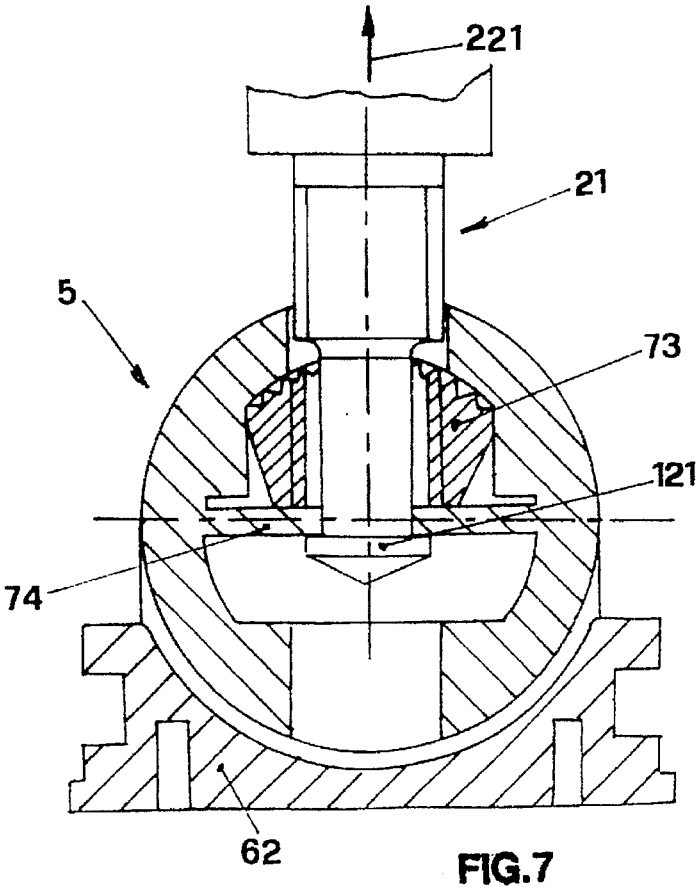
FIG. 7 shows the articulated joint of FIG. 6 with the rod applied to it, while it is being removed.

It has already been said that another purpose of the invention proposes that the antenna can also present antitheft characteristics, such as to prevent the rod 2 from being removed from the supporting base 3 to which it is applied. For this purpose, FIG. 7 shows that if the rod 2 is un-screwed from the threaded through hole 373 within which it is coupled and then is lifted up following the vertical direction indicated by the arrow 221, the conic terminal element 121 stops against the elastic partition 74 which prevents the same from being removed and taken away. The partition 74, in fact, cannot be deformed following the direction 221 by the conic terminal element 121, since the presence of the conductive body 73, which is rigid, prevents any deformation in such a direction. The hole 471, therefore, cannot be widened, consequently the conic terminal element 421 is prevented from passing and the rod 2 from being removed. Therefore, the antenna also presents antitheft characteristics.

In FIG. 9, which represents the detail of the connection between said first articulation element 6 and the base of the antenna 3, it can be observed that the watertight seal in the area 21 which is below said first articulation element 6 and, therefore, in contact with the supporting surface 4 of the antenna, is ensured by the presence of a gasket 131, preferably of the OR type, which is lodged inside an annular groove 161 obtained in the body 62 of said second articulation element 6.

Figure 8:
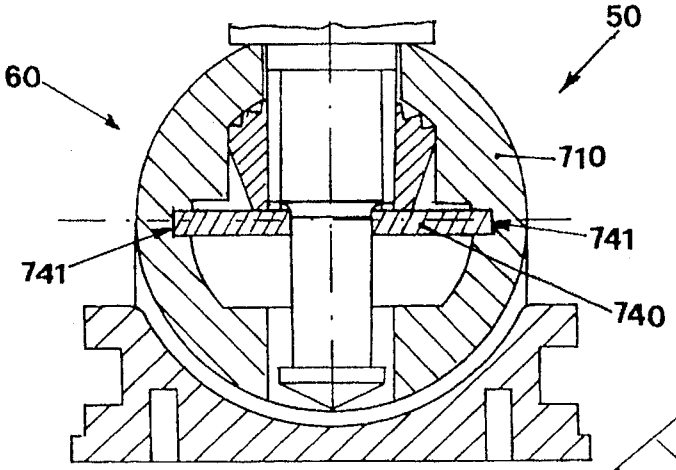
FIG. 8 shows the articulated joint of FIG. 6 while the rod is being oriented.

A different embodiment of the articulated joint of the antenna is represented in FIG. 8, wherein it can be observed that said articulated joint 50 presents said second articulation element, indicated as a whole with 60, wherein the insulating reel 710 is equipped with an elastic partition 740 which, instead of being obtained in a single piece with the body of the reel 710, is added to it since it is lodged inside guides 741 obtained in the body of the reel itself which receive said elastic partition 740.

According to what has been said, it is understood that the antenna according to the invention achieves all the proposed purposes.

During the manufacturing process the antenna may undergo some modifications concerning its shape, its length, its dimensions in general.

The shape and dimensions of articulated joint which connects the rod to its base may change, as may the shape and dimensions of the contrasting elements of the elements which compose the articulated joint.

In particular, with regard to the elements which compose the articulated joint, these may acquire any shape which, rather than being essentially cylindrical as has been described, it can be spheric so as to permit the orientation of the rod of the antenna in space rather than on the surface.

I claim:

1. An antenna comprising a rod connected to a supporting base applied to a surface supporting the antenna, wherein said rod is connected to said supporting base by means of an articulated joint which is formed by a first articulation element rigidly connected to said supporting base by means of first connecting means and by a second articulation element connected to said rod by means of second connecting means, said first and said second articulation elements revolvingly cooperating with each other in order to permit the orientation of said rod of said antenna in relation to said base, and being equipped with contacting means suited to permit the fixing of said rod in any orientation by reciprocal interference between said contacting means, when at least one of said connecting means reciprocally forces said articulation elements; and wherein said first articulation element includes a body formed of conducting material wherein, on one side there is a pair of rings coaxial with one another and placed at a distance from each other and, on the opposite side, there are said first means for the connection of said first articulation element to said base of said antenna and said second articulation element includes an insulating reel having an essentially circular profile, having a seat wherein is inserted a conductive body, the extremities of which axially protrude in relation to said insulating reel and cooperate with the inner surface of said coaxial rings of said first articulation element, said insulating reel being coupled by rotation within a housing having an essentially circular profile, obtained in said first articulation element in the area comprised between said coaxial rings, said insulating reel and said conductive body being equipped with said second means for the connection to said rod of said antenna, said contacting means formed in said coaxial rings and in said conductive body.

2. The antenna according to claim 1, wherein said contacting means comprise first contacting means including an inner toothing obtained on the inner surface of said coaxial rings of said first articulation element and second contacting means including an outer toothing obtained on the outer surface of said conductive body and cooperating with said inner toothing of said first articulation element, said toothing presenting conjugate profiles.

3. The antenna according to claim 2, wherein the inner toothing of the first articulation element and the outer toothing of the second articulation element present each one only two teeth permitting the orientation of the antenna in the vertical direction or in the horizontal direction.

4. The antenna according to claim 1, wherein the body of said first articulation element has an essentially cylindrical shape and is equipped with said first means for the connection to said base of said antenna which consist of an annular area, having a bigger diameter than the diameter of the body and is obtained at the extremity of the body itself, which snap-couples with a corresponding annular duct obtained in said base of said antenna.

5. The antenna according to claim 1, wherein said second means for the connection of said second articulated element to said rod of said antenna, comprise a threaded through hole drilled in the body of said conductive body and an unthreaded through hole, coaxial with said threaded through hole and obtained in an elastic partition which is present inside said insulating reel and which defines said seat wherein said conductive body is inserted, said through holes being suited to lodge the coupling of a terminal element, belonging to said rod of said antenna and made of conductive material, which is inserted into another through hole obtained in the body of said insulating reel.

6. The antenna according to claim 5, wherein said terminal element comprises an essentially cylindrical body, mostly developed following an axial direction, which presents a threaded area obtained in correspondence with said rod of said antenna, an unthreaded area having a smaller diameter than said threaded area, arranged on the continuity of said threaded area and a conic terminal element having a bigger diameter than said unthreaded area and arranged on the continuity of the latter, said unthreaded area being suited to lodge the thickness of said elastic partition of said insulating reel, whenever said threaded area couples with said threaded through hole of said conductive body and said conic element elastically deforms said elastic partition in order to penetrate inside said unthreaded hole of said elastic partition, the presence of said metallic conductive body preventing the deformation of the elastic partition following a direction which is opposite to the direction of the previous deformation, so as to prevent said terminal element from separating from said second articulated joint element.

7. The antenna according to claim 5 wherein said partition is made elastic by at least one through slit obtained in the partition itself and communicating with said through hole drilled in the partition itself.

8. The antenna according to claim 5 wherein said elastic partition is obtained in a single piece with said insulating reel.

9. The antenna according to claim 5 wherein said insulating section is applied to said insulating reel being inserted inside guides obtained in the insulating reel itself.

10. The antenna according to claim 1, wherein the body of said first articulation element externally presents an annular groove suited to lodge a sealing gasket which cooperates by interference with said supporting base, wherein said body of said first articulation element is coupled.

11. An antenna support comprising:

a rod;

a supporting base;

an articulating joint connecting the rod to the supporting base, said articulated joint including a first articulation element and first connecting means rigidly connecting the first articulation element to the supporting base, and a second articulating element and second connecting means for connecting said rod to said second articulation element, said first and second articulation elements being rotatable with respect to each other permitting selectable orientation of the rod with respect to the base, each including contacting means movable with respect to each other for fixedly securing the rod in a selected orientation by reciprocal interference therebetween, and means engaging at least one of said connecting means reciprocally engaging the first and second articulation elements together;

wherein the first articulation element comprises a body formed of conductive material including a pair of coaxial rings having inner walls and being spaced apart by a selected distance along an axis transverse to the first connecting means;

the second articulation element comprises a cylindrical annular reel being formed of insulating material, and a conductive body sleevable within the reel, said reel including a seat for receiving the conducting body therein, the ends of which axially protruding beyond the reel and being sleeved within the coaxial rings of said first articulation element, said insulating reel being rotatable within the rings; and means for threadably connecting the rod with the conductive body for drawing the conductive body against the rings to effect said interference therebetween.

12. The antenna support according to claim 11 wherein the contacting means comprises complementary protruding teeth on the respective inner and outer surfaces of the coaxial rings and the conductive body.

13. The antenna support according to claim 11 wherein the conducting member has a threaded through hole formed therein, the rod comprises an elongated member having a tapered distal end, an unthreaded portion and a threaded portion engaging the corresponding threaded portion of the conductive member.

14. The antenna support of claim 13 wherein the reel is formed with a diametric web and a diametric hole for receiving the rod in alignment with the threaded opening of the conductive member and a diametric slot for receiving a corresponding portion of the conductive member therein.

* * * * *